US005230607A

United States Patent [19]

Mann

[11] Patent Number: 5,230,607

[45] Date of Patent: Jul. 27, 1993

[54] METHOD AND APPARATUS FOR CONTROLLING THE OPERATION OF A PUMPJACK

[76] Inventor: Clifton B. Mann, P.O. Box 44, Maljamar, N. Mex. 88264

[21] Appl. No.: 857,656

[22] Filed: Mar. 26, 1992

[51] Int. Cl.[5] ..... F04B 49/02

[52] U.S. Cl. ..... 417/12; 417/18; 417/44; 417/63; 74/71

[58] Field of Search ..... 417/12, 18, 44, 63; 74/71, 583

[56] References Cited

U.S. PATENT DOCUMENTS

| | | | |
|---|---|---|---|
| 4,184,504 | 1/1980 | Carmichael et al. . | |
| 4,347,049 | 8/1982 | Anderson | 60/372 |
| 4,354,395 | 10/1982 | Page, Jr. | 74/41 |
| 4,363,605 | 12/1982 | Mills | 417/44 |
| 4,406,597 | 9/1983 | Stanton | 60/372 |
| 4,460,039 | 7/1984 | Knight . | |
| 4,462,759 | 7/1984 | McGeehee | 60/372 |
| 4,477,230 | 10/1984 | Knox et al. | 417/63 |
| 4,552,513 | 11/1985 | Miller et al. | 417/18 |
| 4,997,346 | 3/1991 | Bohon . | |

*Primary Examiner*—Richard A. Bertsch
*Assistant Examiner*—David W. Scheuermann
*Attorney, Agent, or Firm*—Hoffman, Wasson & Gitler

[57] ABSTRACT

A method and apparatus for vertically adjusting the stroke of the polished rod of a pumpjack during its operation in a producing well, while detecting abnormal conditions such as gas-off, pump seizure, sucker and separation, gas-lock pounding or fluid pounding. The method and apparatus involves a hydraulic or pneumatic cylinder interposed between the polished rod clamp and the carrier bar of the pumpjack. Abnormal conditions are detected by an electronic device incorporating a pressure transducer which senses fluid pressure changes in the hydraulic or pneumatic cylinder, converts the pressure changes into electrical voltages, and then determines if an abnormal condition is present. If an abnormal condition is sensed, the pumpjack can be stopped, and restarted automatically after a momentary interval in the event of gas-lock or fluid pounding, or manually after inspection by an operator in the event of a more serious condition.

14 Claims, 4 Drawing Sheets

METHOD AND APPARATUS FOR CONTROLLING THE OPERATION OF A PUMPJACK

BACKGROUND OF THE INVENTION

1. Field of the Invention

The present invention belongs to the field of well pumping equipment and is used to control the operation of an artificial lift apparatus, such as a pumpjack, on an operating well.

2. Discussion of the Prior Art

The problems of efficiently operating the pumpjack of an operating oil well, which includes spacing out a down hole pump, gas-lock pounding, as well as fluid pressure pounding conditions have long been concerns in the field of the present invention. However, an economical and easily operated manner of reasons.

When a down-hole sucker rod pump gas locks, the common procedure is to lower the rod string until the rods are pounding bottom. This was accomplished by repositioning the top polish rod clamp four to six inches above the lower polish rod clamp and then loosening the nuts on the bottom polish rod clamp until the rod string "drops" that four to six inches. This process is repeated until the rods are lowered the correct amount. On an 8500-foot well, the typical rod string weighs approximately fourteen thousand pounds, or seven tons. Of course, if the well is deeper the weight increases, or if the well is not as deep the weight decreases. When fourteen thousand pounds is allowed to free-fall four to six inches and then suddenly stops, the resulting shock and stress to the rod string and surface equipment is tremendous.

If the top clamp should fail to stop the downward movement of the rod string, the shock is absorbed by the downhole equipment, which may cause the tubing string to break, the rod string to corkscrew, and/or the pump to be damaged. Great expense is then incurred to retrieve the damaged equipment from the well. In addition, oil field workers may suffer injury if their hands or fingers are caught between the rod clamps when the rods drop.

Fluid pound is a condition that occurs when the fluid level in the well bore is not high enough to allow the sucker rod pump to completely fill. Traditionally, clocks, or mechanical timers, have been used to start the pumpjack for a predetermined amount of time, then to stop it for a predetermined amount of time. The fallacy of this method is that the fluid entry into the well bore may not always be at a uniform rate. Because the clock (mechanical timer) cannot react to the changing well bore conditions, the pumpjack may run too long and create a condition called fluid pounding which is a condition that occurs when the fluid level in the well bore is not high enough to allow the sucker rod pump to become completely filled. Conversely, if the pumpjack does not run long enough, the well is not being pumped to its full potential. Unfortunately, an economical and easily operated manner of solving these problems has proven to be elusive.

SUMMARY OF THE INVENTION

These deficiencies of the prior art are addressed by the present invention which is directed to a fluid pressure driven piston and cylinder apparatus and an associated electronic controller, capable of allowing the polished rod of a pumpjack to pass completely through the cylinder apparatus. The present invention is capable of smoothly and safely adjusting the length of the rod-string and controlling the vertical length of the stroke of the cylinder.

The apparatus of the present invention may readily be field installed between the polished rod clamp and the carrier bar on the pumpjack bridle and causes the pumpjack to raise and lower the rod string smoothly and safely when spacing out a pump. The apparatus eliminates the possibility of top clamp slipping, which could cause parted rods and/or parted tubing and pump damage.

The apparatus of the present invention can be pressurized by either hydraulic pressure, air pressure, water, or other fluids supplied by a suitable pump motor. With the use of an appropriate cylinder-to-wellhead adaptor, and an adequate pressurization system, the mechanism can also be used to pump fluid from an operating well.

The electronic controller can detect a pumped-off condition and shut down the pumpjack utilizing an emergency shutdown circuit. The pumpjack will remain out of operation until the controller detects a predetermined amount of fluid entry, thereby preventing fluid-pound and the resultant stress on the rod string and the pumpjack. The controller can also detect the presence of a gas-lock paraffining-up conditions and fluid pounding.

Accordingly, it is an object of the present invention to provide a fluid operated cylinder mechanism for raising and lowering the sucker rod string on an operating well.

It is another object of the present invention to detect abnormal conditions in an operating well, such as the well being pumped off, gas-lock pounding, fluid pounding, paraffinning-up, parted-rods or pumpjack damage.

It is a further object of the present invention to shut down the pump of an operating well in the event of an emergency situation relating to the smooth and efficient pumping of an operating well.

Various other objects, advantages and features of the invention will become apparent to those skilled in the art from the following disclosure and drawings.

DETAILED DESCRIPTION OF THE PREFERRED EMBODIMENT

Figure 1:
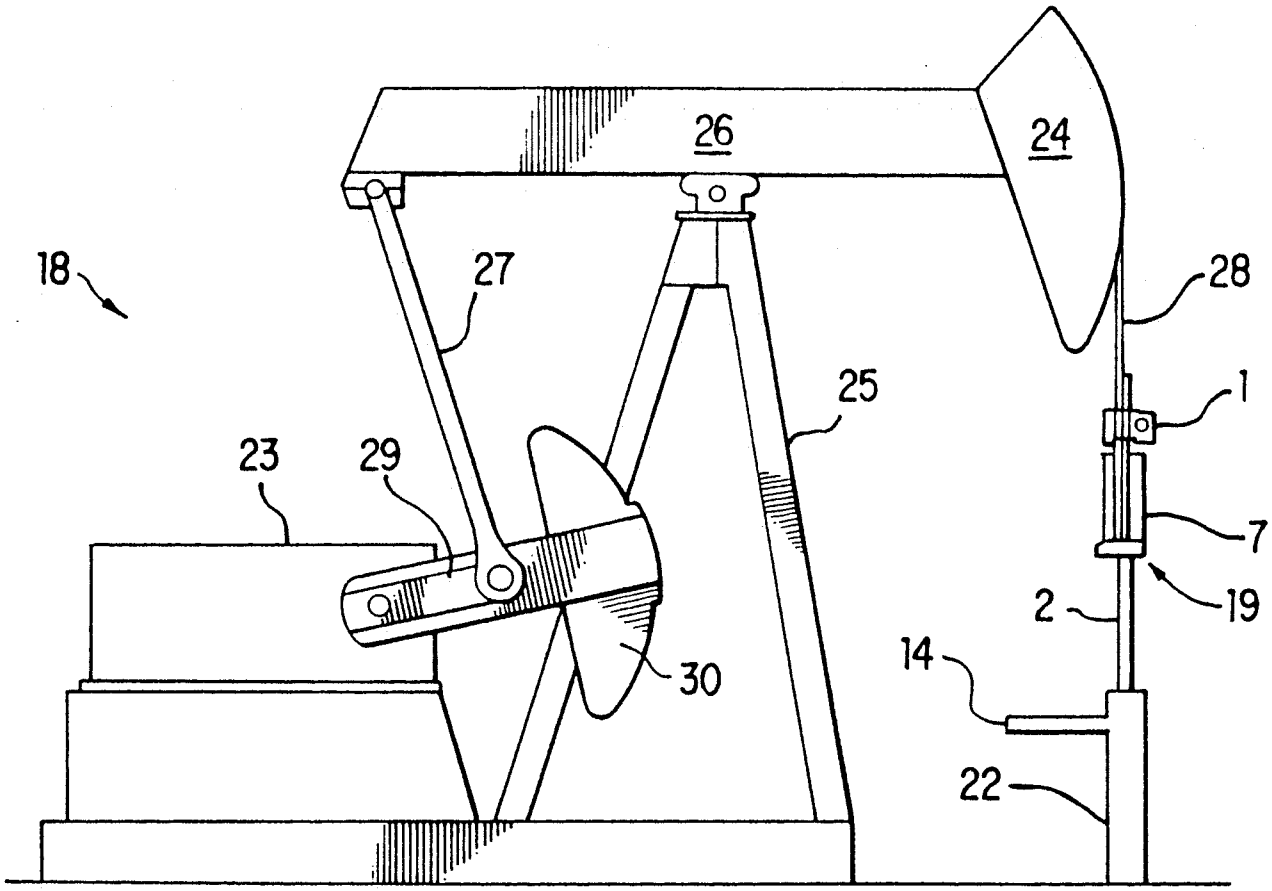
FIG. 1 shows the major components of a functional pumpjack showing the relative location of the present invention installed.

With reference to FIG. 1 of the drawings, the normal operation and the principle components of a conventional artificial lift apparatus (hereafter referred to as a pumpjack 18) to which the present invention is attached. The pumpjack 18 incorporates a prime-mover 23, such as a gasoline or diesel internal combustion engine, an electric motor or any other source of mechanical power, a walking beam 26, a Sampson post 25 on which the walking beam 26 pivots, and a horsehead 24 connected to the walking beam 26. Operatively connected to the horsehead 24 is a polished rod 2. The polished rod 2 is connected, in an effective driving arrangement, to the horsehead 24 by one or more rigid support hangers 28, including a polished rod clamp 1. The hangers 28 may also be semi-rigid wire-rope. The polished rod 2 passes through a wellhead 22. A carrier bar 19 serves to further secure the support hangers 28 to the polished rod 2. The polished rod 2 usually passes through a stuffing box (not shown) on top of the wellhead 22. The polished rod 2 is in turn connected to a sucker rod (not shown). The sucker rod string is connected to a downhole reciprocating pump mechanism (not shown).

At least one pitman arm 27 couples the remote end of the walking beam 26 to one or more crank arms 29, including fly weights. The crank arms 29 are powered by the prime mover 23. Rotation of the crank arms 29 by the prime mover 23 rocks the walking beam 26, which alternately raises and lowers the support hangers 28, and in turn reciprocates the polished rod 2 and the cylinder 7 up and down. The prime mover 23 must run reliably and at a constant speed in order for the pumping operation to function properly.

The down-hole reciprocating pump mechanism (not shown) which is positioned adjacent to a sub-surface producing formation, is operated by the up-down movement of the down-hole sucker rods (not shown) to bring the subsurface fluids to the surface for discharge through an opening 14 in the wellhead 22. The subsurface fluids, once discharged through the opening 14, are led to a pipeline or otherwise productively used.

Figure 2:
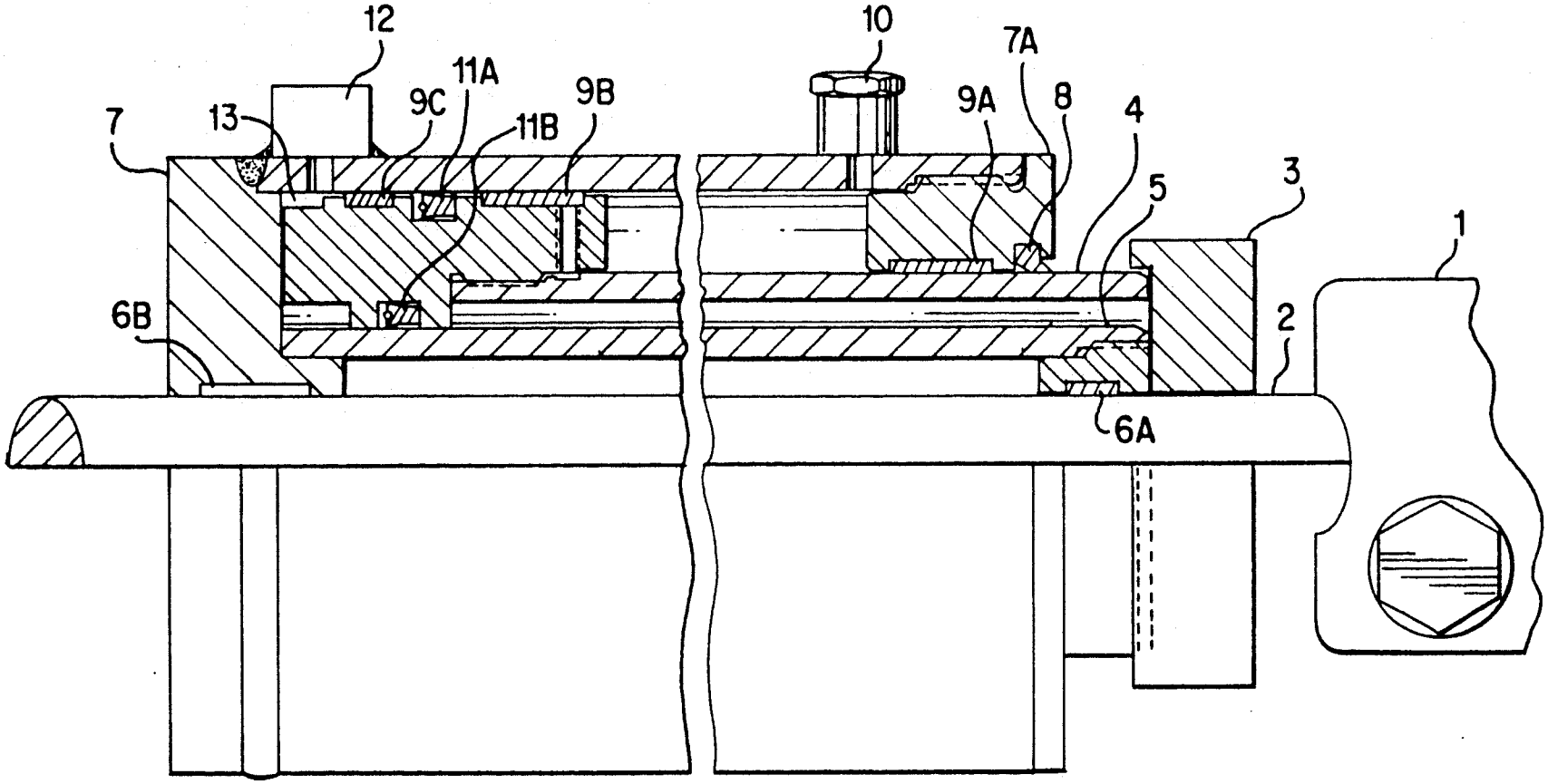
FIG. 2 shows a cut-away view of the apparatus in its working position around the polished rod of a pump string.

With reference now to FIG. 2 of the drawings, the mechanical structure of the present invention will now be described. The inventive cylinder 7 is essentially a precision machined, fluid pressure cylinder casing 7A which encircles a slidably disposed fluid pressure piston 4 and a hollow shaft 5. Fluid pressure piston 4 is slidably positioned within the outer casing 7A. Said piston 4 moves within the cylinder 7 due to the urgings of a pressurized fluid entering a chamber 13 through an inlet/outlet port 12. The fluid is pressurized by a fluid pump 21, and the pressurized fluid is supplied to the chamber 13 via a suitable hose 21A connecting the pump 21 to the inlet/outlet port 12. However, this arrangement would only be used when it is desired to "space out" the pump automatically, or to open and close a motor valve (not shown) on the casing 7A. This would be incorporated to control gas lock, or in any other situation demanding a similar application.

The polished rod 2, which is operatively connected to the conventional pumpjack 18 shown in FIG. 1, passes through the hollow shaft 5 of the cylinder 7, such that the hollow shaft 5 completely encircles the polished rod 2, thereby allowing the polished rod 2 to smoothly pass through the hollow shaft 5. The polished rod 2 is not an integral component of the cylinder 7.

A load bearing end cap 3 is positioned atop the piston 4 with the polished rod clamp 1 resting on top of the end cap 3, and the bottom of the cylinder 7 resting on top of the pumpjack 18, such that the cylinder 7 is positioned between the polished rod clamp 1 and the carrier bar 19 of the pumpjack 18.

In order to raise the polished rod 2, a fluid pump 21 forces, under pressure, a motive fluid into the cylinder chamber 13 through the fluid inlet/outlet port 12, thereby urging the piston 4 to move toward the load bearing end cap 3 which in turn pushes the polished rod clamp 1 upward. As it is rising, the polished rod 2 slidably travels upward with the piston 4. The cylinder 7 is provided with an air vent 10 that allows any air trapped above the piston 4 to vent to the atmosphere as the piston 4 travels upward.

The cylinder 7 is also provided with a wiper 8 which serves to remove or wipe away debris, moisture or other contaminants that would tend to foul the operation of the apparatus. The wiper 3 is seated in a machined groove at the top of the outer piston casing 7A. Wiper 3 serves to wipe the outer surface of the slidably disposed fluid pressure piston 4 as said piston travels in and out of the piston casing 7A.

The cylinder 7 is further provided with seals 11A, 11B. Seal 11A is located in a machined groove near the bottom of the outside of the piston 4 and forms a seal between the outer piston casing 7A and said piston 4. Seal 11B is seated in a machined groove near the bottom inside of the piston 4, and forms a seal between said piston 4 and the hollow shaft 5.

The cylinder 7 is also provided with bushings 6A, 6B, 9A, 9B, 9C, which serve to provide lateral positioning of the components relative to one another, and also to assist in smooth operation of the apparatus. The bushing 6A is situated in a machined groove inside the hollow shaft 5, near its top, while bushing 6B is similarly situated in a machined groove inside the hollow shaft 5, near its bottom. Both bushings 6A, 6B, contact the surface of the polished rod 2. The bushing 9A is situated in a machined groove near the top of the outer piston casing 7A, and contacts the slidably disposed piston 4. Bushings 9B and 9C are one each seated in a machined groove near the bottom of the piston 4, and move with said piston. The bushing 9B is located above the seal 11A, and bushing 9C is located below the seal 11B. The bushings 6A, 6B, 9A, 9B, 9C, the wiper 8, and the seals 11A, 11B, are all made of conventional materials that are well known in the art.

Figure 3:
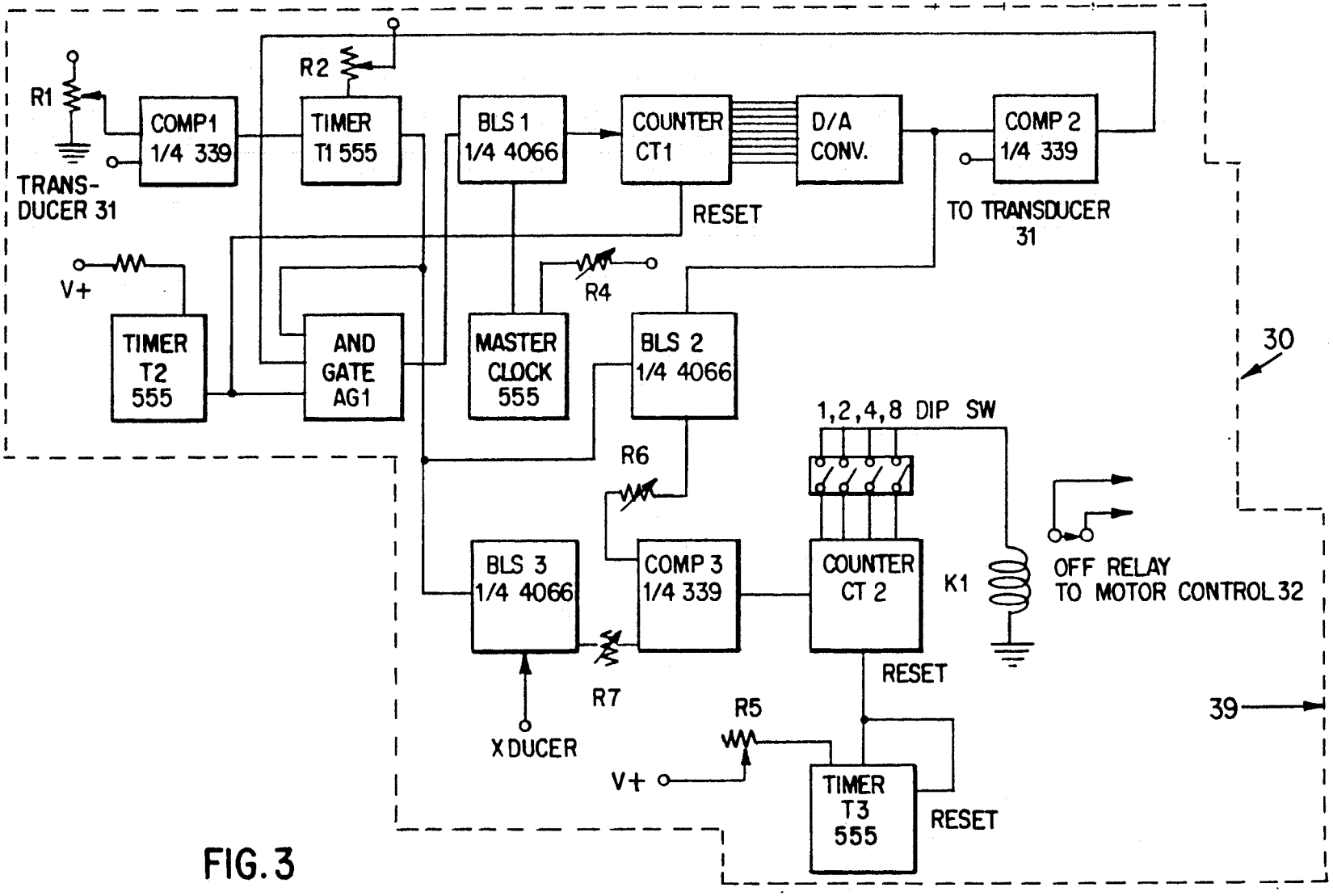
FIG. 3 is a schematic drawing of the pumping controller circuit.

With reference to FIG. 3 of the drawings, the arrangement of the electronic pumpjack controller 30 will now be described. The controller 30 includes a wave sample timer $T_1$, a storage period timer $T_2$, an internal timer $T_3$ and a master clock $T_4$. It is within the contemplation of the inventor that standard RS-555 integrated circuits will serve the function of the timer elements $T_1$–$T_4$, although any operable device of a similar nature would be suitable.

A transducer 31, which is not part of the controller 30 per se, but is electrically connected to the controller 30, measures fluid pressure of the cylinder 7 and outputs a voltage proportional to the fluid pressure measured.

The circuit 30 includes a comparator C1 which compares a reference voltage (set by R1) to a measurement of pressure detected by the transducer 31, hereafter referred to as the voltage/pressure wave. When the measured voltage/pressure is equal to the reference voltage, the comparator C1 output goes to zero and triggers timer T1. Output of T1 goes high for a timing interval (0–10 seconds), T1 changes state. This function is the trigger impulse for all timing functions of the circuit 30 and can be set to any value by varying R2. The trigger impulse occurs on every cycle of the pumpjack.

The trigger pulse, the output of timer T2, and the output of comparator C2 are applied to a 3-input AND gate. As long as all three inputs are the same (Hi or Lo), the AND gate outputs "Hi" to bilateral switch BLS1. BLS1 conducts clock pulses from clock T4 to counter CT1. The counter CT1 starts counting and continues counting until comparator C2 changes state due to Digital-to-Analog Converter output increasing until it is equal to the cylinder 7 wave voltage. When the comparator C2 changes state, the AND gate goes "Lo" switching "Off" bilateral switch BLS1, hence stopping the counter C2. The output voltage of Digital-to-Analog Converter D/A remains constant until timer T2 completes its timing cycle. When T2 changes states, its output resets counter CT1 and the sampling process is reinstated.

During the time that the output voltage of the Digital-to-Analog Converter D/A remains stored, comparator C3 compares the cylinder 7 transducer voltage at the trigger time to the reference voltage established by the Digital-to-Analog Converter D/A. As log as these two voltages remain within tolerance established by resistors R6 and R7, the system continues operating without change. However, if the two voltages differ, comparator C3 sends a difference pulse to Counter CT2. If 1, 2, 4, or 8 pulses (selectable by user) are detected in a particular interval (determined by timer T3 which resets CT2 at the end of each timing interval), then an output voltage is applied to relay R1 which is connected into the pumpjack motor control circuit 30 via its normally closed contacts. This de-energizes the pump motor for another delay period determined by timer T4. After T4 "Off" delay, pumpjack 18 will restart and continue until another difference condition occurs.

If pump seizure or sucker rod separation is detected, an emergency shut down is initiated and the prime-mover or motor 23 cannot be restarted until "reset" is manually operated, thereby insuring attention by the user. However, gas-lock pounding and fluid pounding cause only timed shut downs, and the timer is user determined. Additionally, when gas-lock occurs, the user can choose to have the cylinder 7 lower the rods (for a specified amount of time) until the rods are pounding bottom. When the gas-lock condition is alleviated, the rods are raised to a normal position by the proper hydraulic equipment. This, of course, requires an adequate fluid pump 21. Another option is to have the cylinder 7 signal the controller 30 to close a motor valve on the casing 7A until a specified casing pressure is obtained.

Figure 4:
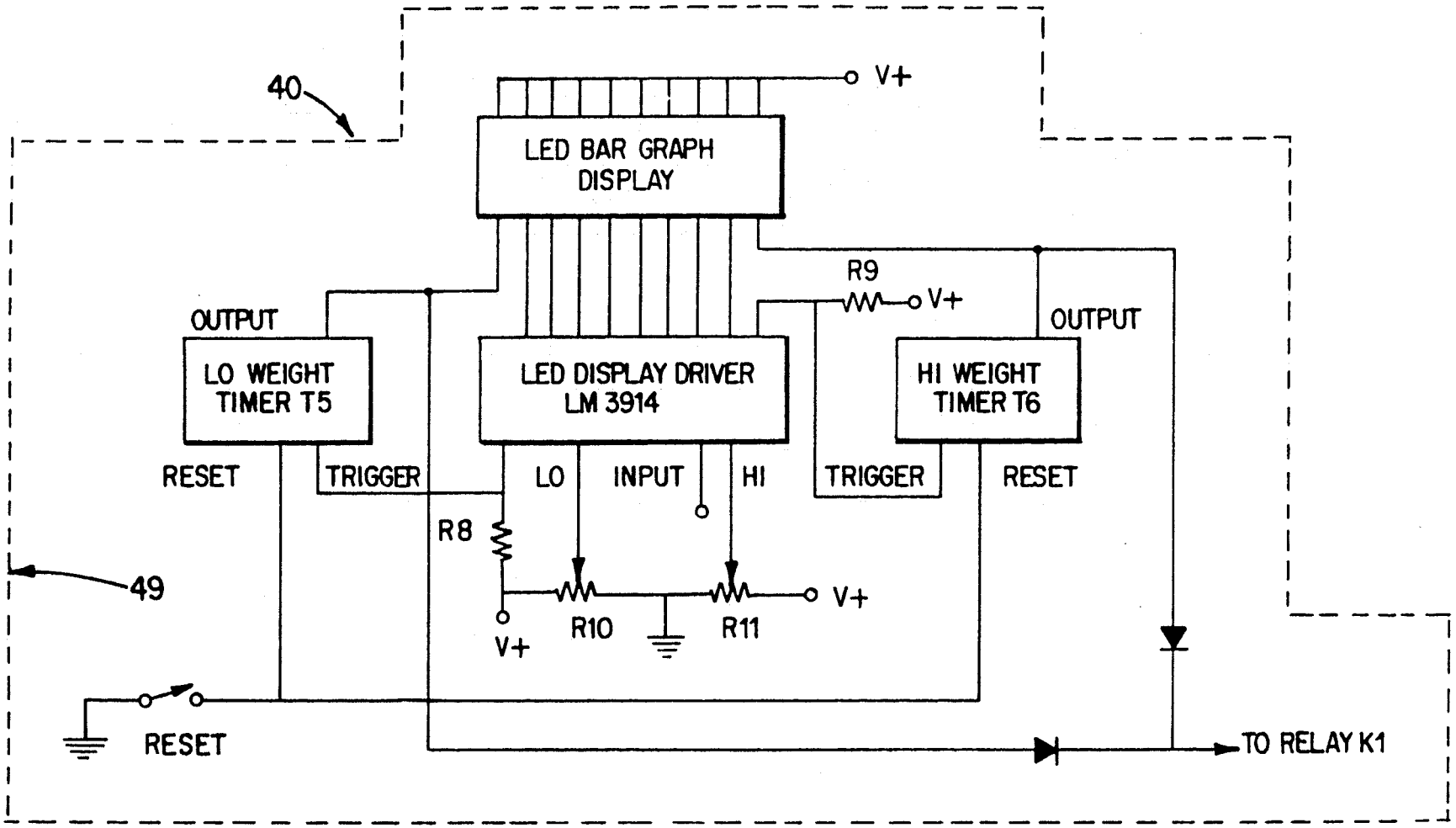
FIG. 4 is a schematic drawing of the emergency shut-down detector circuit.

A power supply 33 satisfies the voltage and current requirements of the controller 30 and an emergency condition shut-down circuit 40 described with reference to FIG. 4 later, by providing power which is applied at terminal V+. In the preferred embodiment, the power supply 33 is a commercially available 12 V, 500 MA regulated power supply (RPS) initially powered by a standard 120 VAC power line. The power supply 33 may be remotely located from the controller 30 with connections made to the controller 30 via UL-approved wiring suitable for their usage. The power supply 33 may also be incorporated into the controller housing 39, in which case adequate ventilation of the housing 39 is required, and suitable wiring connections must also be made.

The controller 30 may incorporate the emergency condition detector and shut-down circuit 40, although the circuit 40 may be separate. The circuit 40 incorporates a display 41, a lo-weight timer $T_5$, hi-weight timer $T_6$, and variable resistors R10, R11. The power supply 33 also provides adequate power to the circuit 40.

Discussion of the emergency condition shut-down circuit 40 will be described with reference to FIG. 4. The circuit 40 uses the voltage/pressure measurement of the cylinder 7 as measured by the transducer 31. If the measured voltage/pressure goes above or below the normal range by a user adjustable amount, the circuit 40 activates a relay which is connected to the control circuit 30 and de-energizes the prime mover 23.

The measured voltage/pressure is provided to a dot display driver, such as an LM 3914 of the equivalent. An LED bar graph displays the input voltage. This provides a visible display with which to monitor the voltage/pressure sensed by the transducer 31. The range of this display is determined by variable resistors R10 and R11, which set the Lo and Hi voltages of lo-weight timer $T_5$ and hi-weight timer $T_6$. It is within the contemplation of the present invention that standard RS-555 integrated circuits (ICs) will well serve as $T_5$ and $T_6$, although any operable device of an equivalent design would be suitable.

Comparator outputs 1 and 10 are connected to the timers $T_5$ and $T_6$ which are used only for relay drivers, and not as timers. If outputs 1 or 10 go "Lo", then relay R1 is energized and remains energized until the "reset" switch is actuated. If output 1 goes "Lo", then LED 1 on the LED bar graph display remains lit, indicating a sucker rod separation. If output 10 goes "Lo", then LED 10 remains lit, indicating pump seizure or other high weight condition.

Among the emergency conditions that the circuit 40 responds to are gas-lock pounding and fluid pounding. The circuit 40 stores the measured voltage/pressure detected by the transducer 31 at a specific instant during the pumpjack cycle. This instant is determined by a variable timer which is triggered by the pump cycle voltage change and starts a delay interval. At the end of the delay interval, the timer changes state and starts the digital voltmeter. Thus, any part of the voltage/pressure may be sampled and stored. The storage period is determined by another adjustable timer.

After the voltage/pressure is sampled and saved, it becomes the reference level which is compared by a voltage comparator at each pump cycle to the same point on each cycle wave. If each subsequent pumpjack provides the same voltage at that point on the pumpjack cycle, the system remains "On". However, if the two voltages differ by a user adjustable amount, the comparator outputs a voltage pulse to a digital counter. If 1, 2, 4 or 8 (programmable) of these difference pulses occur within a user selected interval, the circuit activates a relay which turns the pump motor "Off". An adjustable delay timer determines the length of the shut-down interval.

A fluid pounding condition is detected by the circuit 40 by also using the measured pressure/voltage signal generated by the transducer 31; however, fluid pressure pounding detection requires that the transducer 31 be field calibrated to another area of the pressure/voltage range. The adjustable timer, is correspondingly calibrated to adjust the length of the shut down interval. In order to detect fluid pounding, the circuit 40 counts the difference pulses and activates the sequence of pump relays to halt the pumping action.

The circuit 40, if not made part of the controller circuit 30, can be enclosed within its own housing 49. The housing 49 could be similar in design and construction to the controller housing 39. Suitable electrical connection to the energized elements of the circuit 40 are made to the power supply 33, via UL approved lead wires (not shown) suitable for their purpose, passing through the wall of the housing 49. In the event that the circuit 40 stands separate and apart from the controller 30.

It will be appreciated that the above description relates to the preferred embodiment only, and it will be appreciated by persons having ordinary skill in the art to which the features of this invention pertain, that many variations, other than those cited herein, are possible. As such, any variations of the invention that are obvious to those having ordinary skill in the art are deemed to be within the scope of the invention herein claimed, whether or not expressly described.

I claim:

1. An electronic fluid pump controller and electronic artificial lift motor controller for determining whether an emergency condition exits in a fluid pressure cylinder associated with an artificial lift apparatus used in an operating well, comprising:

a pumpjack operationally connected to the artificial lift apparatus;

a fluid pressure cylinder;

a fluid pressure transducer for measuring the fluid pressure within said fluid pressure cylinder, said fluid pressure transducer producing an electrical signal proportional to the fluid pressure within said cylinder;

a comparator unit for comparing the electrical signal produced by said transducer to a reference signal, said comparator unit producing an output signal for disabling said pumpjack when an emergency condition is sensed.

2. The electronic fluid pump controller and electronic artificial lift motor controller in accordance with claim 1, further including a timer means for producing the reference signal used as one of the inputs to said comparator unit.

3. The electronic fluid pump controller and electronic artificial lift motor controller in accordance with claim 1, further including a counter connected to said comparator; and a relay connected to said counter for disabling said pumpjack after a predetermined time has elapsed after said comparator produces the output signal for disabling said pumpjack.

4. The electronic fluid pump controller and electronic artificial lift motor controller in accordance with claim 1, further including a visual display for displaying the electrical signal produced by said fluid pressure transducer.

5. The electronic fluid pump controller and electronic artificial lift motor controller in accordance with claim 4, further including a visual display for displaying the electric signal produced by said fluid pressure transducer.

6. The electronic fluid pump controller and electronic artificial lift motor controller in accordance with claim 5, further including a visual display for displaying the electrical signal produced by said fluid pressure transducer.

7. A fluid pressure operated apparatus capable of allowing smooth controlled reciprocating movement of a polished rod therethrough, and a carrier bar operatively attached to said polished rod, included in an artificial life apparatus, operating on a fluid producing well, said apparatus comprising:

an outer piston casing having a top end and a bottom end, an inside surface and an outside surface;

a hollow shaft fixedly attached to said bottom end of said outer piston casing, said hollow shaft having a central through-bore for receiving said polished rod in smoothly slidable relation;

a slidably disposed fluid pressure piston disposed between said outer piston casing and said hollow shaft, said piston having an upper end and a lower end, an outside surface and an inside surface;

a removable load bearing end cap seated upon said end of said piston;

an air vent located near said top of said outer piston casing for venting to the atmosphere internal air pressure displaced within said casing when said piston travels toward said top end of said casing;

an outer casing piston surrounding said hollow shaft and sealed by said end cap, said piston slidably disposed within said cylinder;

a packing assembly, including a first seal seated in a machined groove located on the lower outside end of said piston, and a second seal seated in a machined groove located on the lower inside end of said piston, whereby said first seal forms a fluid tight closure between the piston and the inside surface of said piston casing and said second seal forms a fluid tight closure between the piston and said hollow piston;

a fluid pressure port leading through said outer casing, said port serving as an outlet port;

whereby, when pressurized fluid is fed into said piston casing, said piston travels to bear against said end cap so as to contact said polished rod clamp thereby urging said polished rod a distance proportional to the length of the travel of said piston.

8. The invention of claim 7 wherein said load bearing end cap contacts said slidably disposed fluid pressure piston.

9. The invention of claim 7 wherein said hollow shaft is fixedly attached to said outer piston casing.

10. The invention of claim 7 further comprising a wear bushing seated in a machine groove located at the inside top end of said outer piston casing.

11. The invention of claim 7 further comprising first and second bushings, one each seated in machined grooved near the bottom end of said piston, whereby said bushings align said piston within said outer piston casing.

12. The invention of claim 7, further comprising third and fourth bushings, said third bushing being seated in a machine groove near the top inside surface of said hollow shaft and said fourth bushing being seated in a machined groove near the bottom inside surface of said hollow shaft, whereby said third and fourth bushings align the top and bottom, respectively, of said hollow shaft around said polished rod.

13. The invention of claim 7 further comprising a wiper disposed in a machined groove disposed near the top inside surface of said outer piston casing and contacting said piston, whereby debris, moisture, dust, and other foreign matter are prevented from entering said cylinder.

14. The invention of claim 7, including a means for securing said cylinder between the polished rod and the carrier bar of the artificial lift apparatus.

* * * * *